US010136675B2

(12) United States Patent
Li et al.

(10) Patent No.: US 10,136,675 B2
(45) Date of Patent: Nov. 27, 2018

(54) ATOMIZER OF ELECTRONIC CIGARETTE, CERAMIC HEATING ATOMIZING CORE AND CERAMIC HEATER THEREIN

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Shuyun Hu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/494,513

(22) Filed: Apr. 23, 2017

(65) Prior Publication Data

US 2017/0224018 A1 Aug. 10, 2017

(30) Foreign Application Priority Data

Apr. 22, 2016 (CN) ..... 2016 2 0343783 U
Apr. 27, 2016 (CN) ..... 2016 2 0367554 U

(51) Int. Cl.
*A24F 13/00* (2006.01)
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/008; B05B 3/46
USPC ..... 131/329, 328
See application file for complete search history.

(56) References Cited

U.S. PATENT DOCUMENTS 6,797,925 B1 9/2004 Gunther et al.
2014/0130816 A1* 5/2014 Liu ..... A24F 47/008 131/329
2015/0157055 A1* 6/2015 Lord ..... A24F 47/008 131/329
2015/0181937 A1* 7/2015 Dubief ..... A24F 47/008 131/329
2015/0181943 A1 7/2015 Li et al.
2015/0296887 A1* 10/2015 Zhu ..... A24F 47/008 131/329
2016/0135505 A1* 5/2016 Li ..... H05B 3/44 131/329
2016/0143358 A1* 5/2016 Zhu ..... A24F 47/008 131/329
2016/0157522 A1* 6/2016 Zhu ..... A24F 47/008 131/329

(Continued)

*Primary Examiner* — Hae Moon Hyeon
(74) *Attorney, Agent, or Firm* — Cheng-Ju Chiang

(57) ABSTRACT

An atomizer of electronic cigarette, ceramic heating atomizing core and ceramic heater are provided. The ceramic heater is configured to atomize liquid to form aerosol. The ceramic heater includes a ceramic body and a heating element, the ceramic body includes a wall having an inner surface and an outer surface, the wall defining a plurality of through holes passing through the inner and outer surfaces to release the aerosol. The heating element is formed on one of the inner and outer surfaces of the ceramic body. The ceramic heater of the present disclosure could heat overall and the aerosol could be release in time, the atomization efficiency of the ceramic heater could be increased.

16 Claims, 7 Drawing Sheets

(56) References Cited

U.S. PATENT DOCUMENTS

| | | | | |
|---|---|---|---|---|
| 2017/0079332 | A1 | 3/2017 | Li et al. | |
| 2017/0105454 | A1* | 4/2017 | Li | A24F 47/008 |
| 2017/0251729 | A1* | 9/2017 | Li | A24F 47/008 |
| 2017/0325510 | A1* | 11/2017 | Hu | A24F 47/008 |

* cited by examiner

ATOMIZER OF ELECTRONIC CIGARETTE, CERAMIC HEATING ATOMIZING CORE AND CERAMIC HEATER THEREIN

CROSS REFERENCE TO RELATED APPLICATIONS

This application claims priority to Chinese Patent Application No. 201620343783.8 filed on Apr. 22, 2016 and Application No. 201620367554.X, filed on Apr. 27, 2016, which are hereby incorporated by reference herein as if set forth in its entirety.

TECHNICAL FIELD

The present disclosure generally relates to the field of electronic cigarette, and more particular relates to a ceramic heater, which has high atomization efficiency.

BACKGROUND

As the substitute of the traditional cigarette, electronic cigarette is accepted by more and more smokers, owing to its safe, convenience, environmental, and its large reduction of harm to humans. Electronic cigarette in the prior art includes atomizer and battery assembly, the atomizer includes atomizing core and liquid reservoir. The atomizing core atomizes the liquid to form aerosol by heating, so as to simulate traditional cigarettes.

For example, a typical atomizing core in prior art is assembled by a heating wire and a glass-fiber core configured to absorb the liquid and supply the liquid to the heating wire. However, the heating wire and glass-fiber core have a small contact area, and the glass-fiber core is not heating overall, which may result in low atomization efficiency. In addition, the heating wire and glass-fiber core need to be assembled manually, it is difficult to realize automated production, which may result in poor product consistency.

DETAILED DESCRIPTION

For a thorough understanding of the present disclosure, numerous specific details are set forth in the following description for purposes of illustration but not of limitation, such as particularities of system structures, interfaces, techniques, et cetera. However, it should be appreciated by those of skill in the art that, in absence of these specific details, the present disclosure may also be carried out through other implementations. In other instances, a detailed description of well-known devices, circuits, and methods is omitted, so as to avoid unnecessary details from hindering the description of the disclosure.

Figure 1:
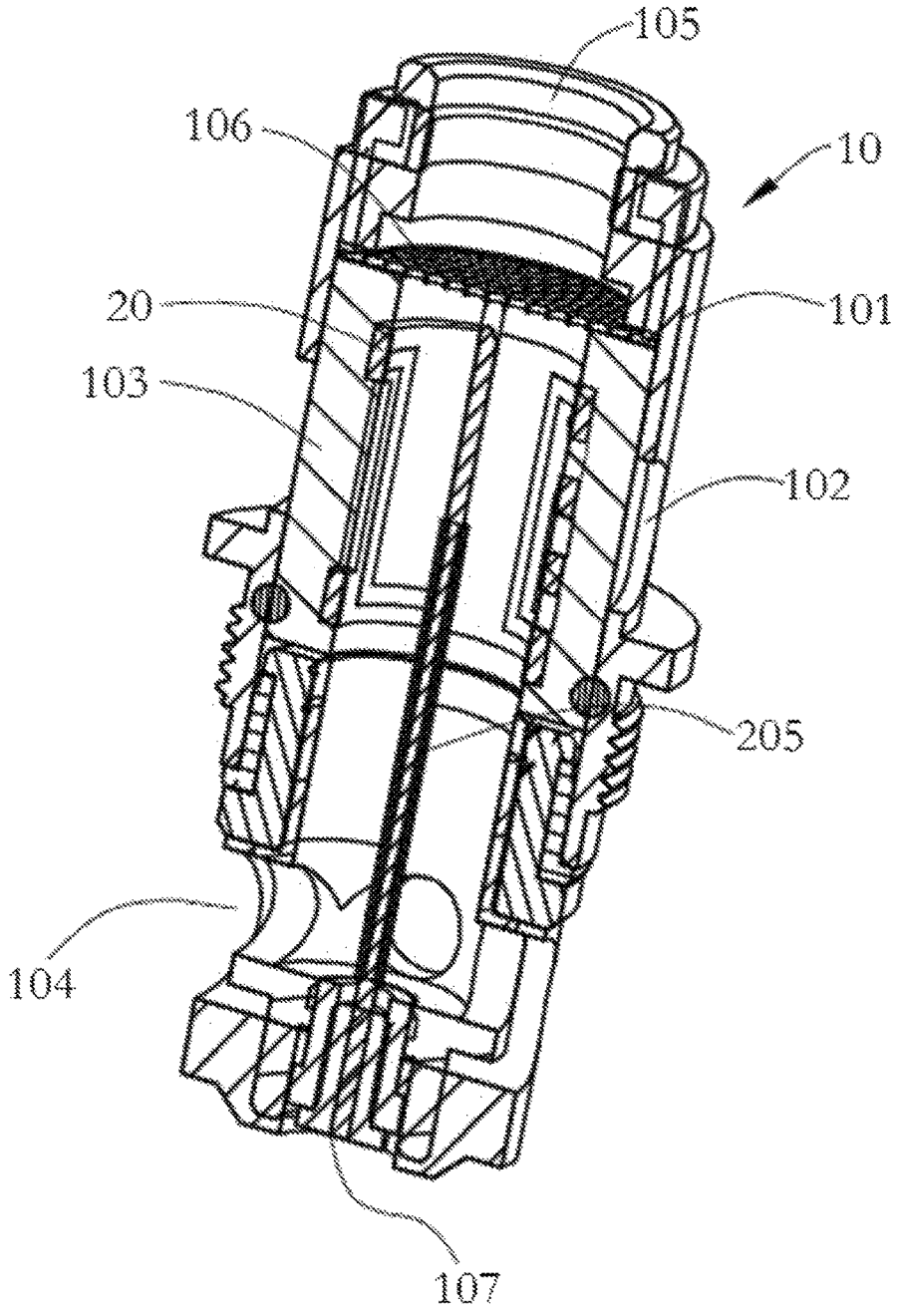
FIG. 1 is a perspective view of internal structure of the ceramic heating atomizing core according to one embodiment of the disclosure.

Referring to FIG. 1, a ceramic heating atomizing core 10 of electronic cigarette of one embodiment may include a ceramic heater 20, a liquid guiding body 103 used to supply liquid for the ceramic heater 20, and a shell 101 used to carry the ceramic heater 20 and the liquid guiding body 103. The ceramic heater 20 and the liquid guiding body 103 may be located inside the shell 101. At least one liquid inlet 102 may be defined in the shell 101. In this embodiment, the shell 101 may have a tube configuration, there are 4 liquid inlets 102 distributed uniformly along a circumference of the shell 101.

In one embodiment, an air inlet 104 may be disposed at one end of the shell 101, and an air outlet 105 may be disposed at the other end of the shell 101. The liquid may flow into the shell 101 and be absorbed by the liquid guiding body 103, and then be heated and atomized to form aerosol by the ceramic heater 20. The aerosol may be taken away by air current entered from the air inlet 104, and discharged from the air outlet 105. An electric connection part 107 used to connect to an external power supply and a controller may be arranged at the end of the shell 101 which provided with the air inlet 104.

In this embodiment, the liquid guiding body 103 may be cotton cloth surrounding the ceramic heater 20, the cotton cloth may absorb the liquid entering from the liquid inlet 102. It can be understood that, in other embodiments, the liquid guiding body 103 may also be made of glass-fiber core, micro-porous ceramic or other micro-porous material with micro-porous capillary osmosis. A filter net 106 is arranged between the liquid guiding body 103, the ceramic heater 20 and the air outlet 105. The filter net 106 may filter big drop that is atomized insufficiency, and press the liquid guiding body 103 to prevent the liquid guiding body 103 from displacing.

Figure 2:
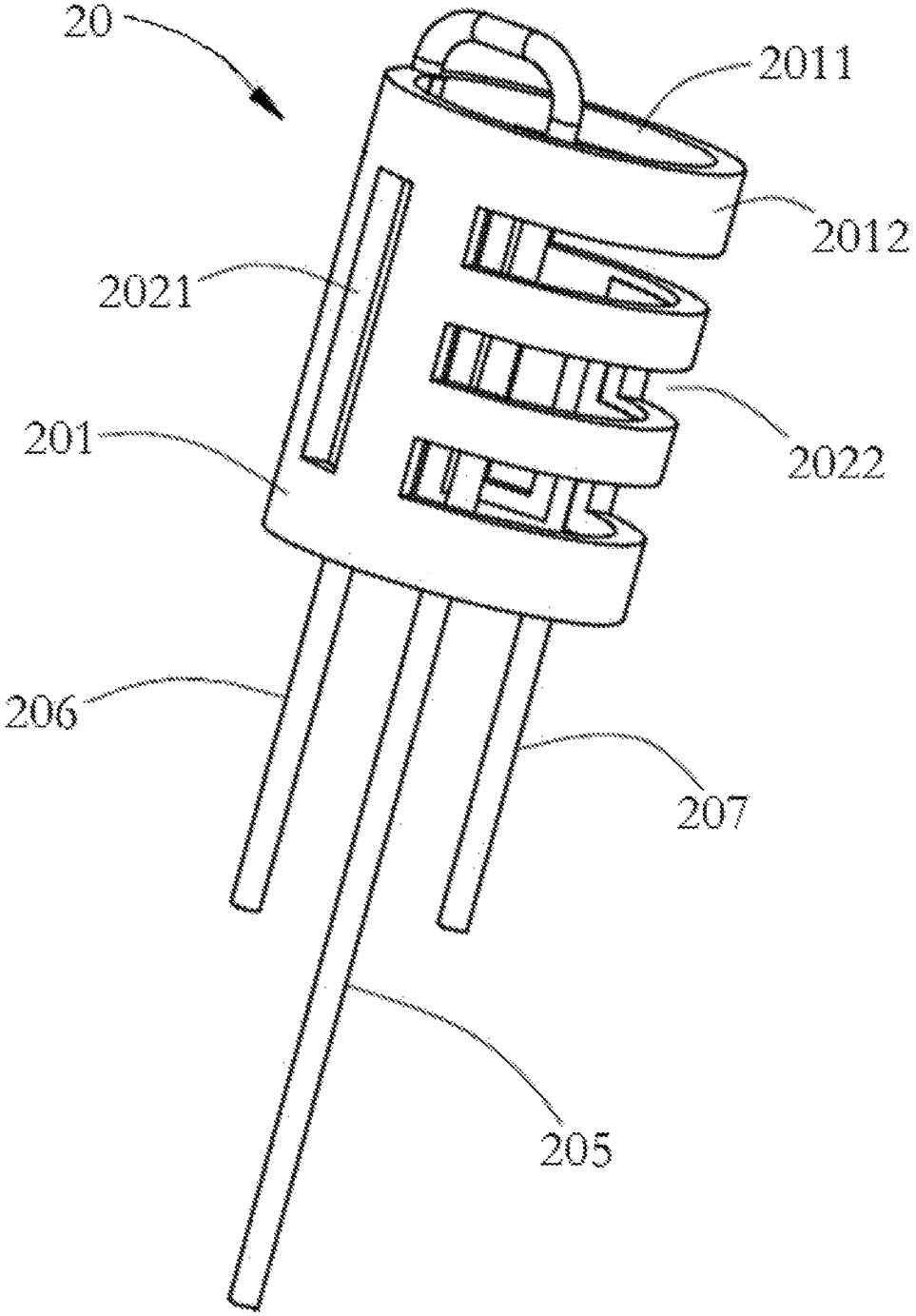
FIG. 2 is a perspective view of the ceramic heater in the ceramic heating atomizing core shown in FIG. 1 according to one embodiment of the disclosure.
Figure 3:
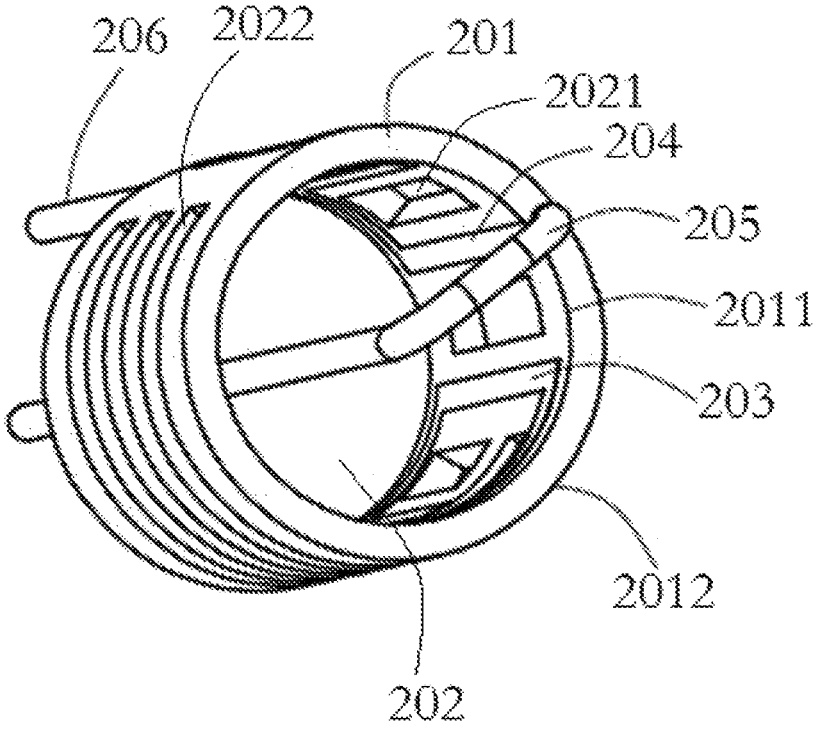
FIG. 3 is a perspective view in another angle of the ceramic heater shown in FIG. 2 according to one embodiment of the disclosure.

The ceramic heater 20 may have a plurality of structures. Referring to FIG. 2 and FIG. 3, the ceramic heater 20 in this embodiment may include a ceramic base 201 and a heating element 203 which is integrally sintered with the ceramic base 201. The ceramic base 201 may include a wall having an inner surface 2011 and an outer surface 2012, the heating element 203 may be formed on the inner surface 2011, and the liquid guiding body 103 is in contact with the outer surface 2012. Because of the high thermal conductivity of ceramic, the ceramic base 201 may generate heat together with the heating element 203 to heat and atomize the liquid supplied by the liquid guiding body 103 to form aerosol. A plurality of through holes 2021, 2022 passing through the inner surface 2011 and the outer surface 2012 may be defined in the wall of the ceramic base 201. The through holes 2021, 2022 may be elongated holes or round holes.

The ceramic base 201 may have a tube configuration, an air-flow passage 202 may be defined in the middle of the ceramic base 201 for aerosol and air current flowing through, and the through holes 2021, 2022 may be defined in the wall of the ceramic base 201. In this embodiment, the liquid guiding body 103 may cover around and contact with the outer surface 2012, while the heating element 203 is formed on the inner surface 2011. The liquid absorbed by the liquid guiding body 103 may be evaporated to form aerosol out of the wall of ceramic base 201, then, released to the air-flow passage 202, and finally, discharged. Because the plurality of through holes 2021, 2022 is disposed in the ceramic base 201 evenly, the aerosol may be released smoothly, and atomization efficiency of the liquid is increased. Furthermore, the liquid guiding body 103 may be made of flexible materials, such as cotton cloth, when the cotton cloth is wrapped around the ceramic base 201, some portion of the cotton cloth may protrude from the through holes 2021, 2022, which may increase the contact area between the liquid and the ceramic base 201.

The inner surface 2011 and the outer surface 2012 may be arc surfaces, in other embodiments, the inner surface 2011 and the outer surface 2012 may be planes, that is, the ceramic base 201 has a plane configuration, and the inner surface 2011 is one side surface of the plane, and the outer surface 2012 is the other side surface of the plane.

The plurality of through holes 2021, 2022 may extend along an axial or circumferential direction of the ceramic base 201. In this embodiment, the through holes 2021 may extend along an axial direction of the ceramic base 201, that is, the through holes 2021 extend up and down along the axial direction of the ceramic base 201, while the through holes 2022 may extend along a circumferential direction of the ceramic base 201, which may increase the space for releasing the aerosol.

In this embodiment, the heating element 203 may be a metal heating layer printed on the inner surface 2011 of the ceramic base 201, the metal heating layer may be connected to a first electrode 206 and a second electrode 207 which are used to connect to a power supply. The ceramic heater 20 may be formed by Metal Ceramics Heater (MCH) technology. The process may be as follows: Firstly, defining a plurality of through holes (i.e. the through holes 2021 and through holes 2022) with different shapes in a piece of ceramic paper according to different demands. Secondly, printing the metal heating layer in the ceramic paper according with a certain pattern to form the heating element 203. Then, stacking the heating element 203 with the ceramic base 201, and the ceramic paper is located at the inner surface 2011. Finally, sintering the heating element 203 and ceramic base 201 into a whole with high temperature.

A thermistor layer 204 with positive temperature coefficient or negative temperature coefficient may be printed on the inner surface 2011, the thermistor layer 204 may be isolated from the metal heating layer. The thermistor layer 204 may be connected to one temperature control-electrode 205 passing through the air-flow passage 202, and the temperature control-electrode 205 may be used for feeding back temperature information. The thermistor layer 204 may be further connected to one of the first electrode 206 and the second electrode 207 as a common electrode. For example, the temperature control-electrode 205 is a positive pole, the common electrode selecting from one of the first electrode 206 and the second electrode 207 is a negative pole, such that the ceramic heater 20 has a structure of 3PIN with function of temperature controlling. The first electrode 206, the second electrode 207 and the temperature control-electrode 205 are connected to the electric connection part 107 of the ceramic heating atomizing core 10 respectively.

As a temperature control module, the resistance of the thermistor layer 204 may be varied with temperature. When receiving the temperature information, the controller of the external power supply may control to adjust the output voltage or current, so as to make the ceramic heater 20 heat with constant temperature. Because both of the thermistor layer 204 and the metal heating layer are located on the inner surface 2011 and close to each other, the thermistor layer 204 could feed back the atomization temperature more accuracy, which may make the controlling of the temperature more precisely.

In other embodiments, the ceramic heater 20 may have a 2PIN structure, that is, the ceramic heater 20 may include only two electrodes, i.e. the first electrode 206 and the second electrode 207. The metal heating layer printed on the inner surface 2011 may be a metal-variable resistance with positive temperature coefficient or negative temperature coefficient, which may make it realize that feeding back the temperature information by the metal heating layer itself.

The ceramic heater 20 is formed by sintering the ceramic base 201 and the heating element 203 integrally with high temperature. When being used, the ceramic heater 20 is covered by the liquid guiding body 103, such as cotton cloth or other liquid guiding body with thermostability. The aerosol, formed by the liquid atomized by ceramic heater 20, may be released through the through holes 2011, 2012, which play as releasing channels of the aerosol, and the aerosol enters into user's mouth through the air-flow passage 202. Compared with heating wire of prior art, the ceramic heater 20 may have higher atomization efficiency, because the ceramic heater 20 could heat overall and the aerosol could be release in time, and furthermore, assembly process could be reduce because of the integral structure of the ceramic heater 20.

In addition, the thermistor layer 204 with positive temperature coefficient or negative temperature coefficient is provided on the inner surface 2011 of the ceramic base 201, the thermistor layer 204 and the metal heating layer are isolated from each other. The thermistor layer 204 is connected to a temperature control-electrode 205 used to feed back temperature information, and the thermistor layer 204 is also connected to one of the first electrode 206 or the second electrode 207 as a common electrode. Therefore, the ceramic heater 20 may form a 3PIN structure, and in the 3PIN structure, the temperature controlling mode formed by the heating element 203 and the temperature controlling mode formed by the thermistor layer 204 are exist independently and isolated from each other, the temperature control-electrode 205 could feed back the temperature information to the controller of the external power supply in time, so as to control the ceramic heater 20 to maintain a constant temperature or constant heating power, which may make the ceramic heater 20 heat uniformity, and make it realize that controlling temperature more precisely.

Figure 4:
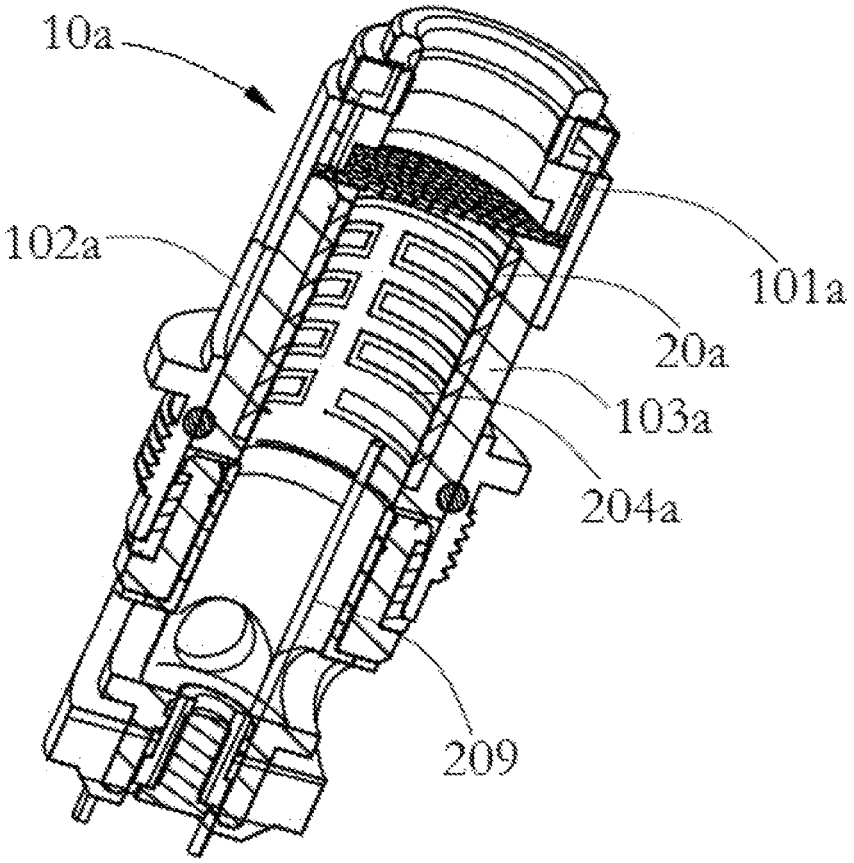
FIG. 4 is a perspective view of internal structure of the ceramic heating atomizing core according to another embodiment of the disclosure.

Referring to FIG. 4, the ceramic heating atomizing core 10*a* of this embodiment may include a ceramic heater 20*a* configured to atomize liquid to form aerosol, a liquid guiding body 103*a* configured to supply liquid for the ceramic heater 20*a* and a shell 101*a* configured to carry the ceramic heater 20*a* and the liquid guiding body 103*a*. The ceramic heater 20*a* and the liquid guiding body 103*a* may be located inside the shell 101*a*, and the liquid guiding body 103*a* may be arranged between the ceramic heater 20*a* and the shell 101*a*. At least one liquid inlet 102*a* is defined in the shell 101*a*.

Figure 5:
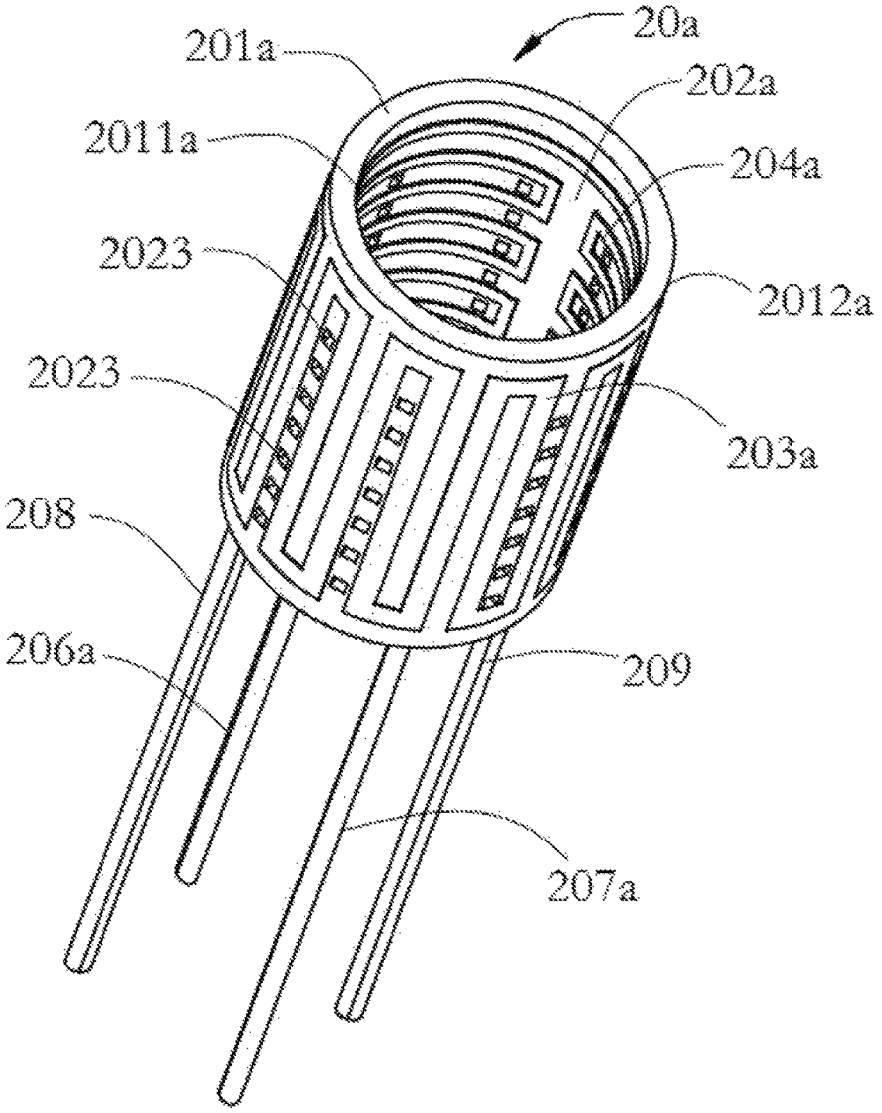
FIG. 5 is a perspective view of the ceramic heater in the ceramic heating atomizing core shown in FIG. 4 according to another embodiment of the disclosure.

As shown in FIG. 5, the ceramic heater 20*a* may include a ceramic body 201*a*, a heating element 203*a* integrally sintered with the ceramic body 201*a* and a thermistor layer 204*a*. An air-flow passage 202*a* passing through the ceramic body 201*a* is defined in middle of the ceramic body 201*a*, and the air-flow passage 202*a* is configured to discharge the aerosol.

The ceramic body 201*a* may include a wall having an inner surface 2011*a* and an outer surface 2012*a*, the heating element 203*a* is formed on the outer surface 2012*a*, and the liquid guiding body 103*a* is in contact with the outer surface 2012*a*.

The heating element 203*a* is a metal heating layer printed on the outer surface 2012*a*, the metal heating layer is connected to a first electrode 206*a* and a second electrode 207*a* which are used to connect a power supply. The metal heating layer may be made of a material with a resistance which may reduce with the increasing of temperature. The metal heating layer may be bent around on the surface of the ceramic body 201*a*, one end of the metal heating layer may be connected to the first electrode 206*a*, so as to connect the metal heating layer to the positive pole, while the other end of the metal heating layer may be connected to the second electrode 207*a*, so as to connect the metal heating layer to the negative pole. The metal heating layer may be formed to be a variety of different patterns, so as to increase the contact area of the metal heating layer and the liquid.

The thermistor layer 204*a* arranged on the ceramic body 201*a* and isolated from the heating element 203*a* may be made of material with positive temperature coefficient or negative temperature coefficient, and the thermistor layer 204*a* may also be formed to be different patterns. In this embodiment, the thermistor layer 204*a* is made of material with temperature variation coefficient, such as, nickel, $BaTiO_3$ crystal, et cetera. The thermistor layer 204*a* may be connected to a first temperature control-electrode 208 and a second temperature control-electrode 209, which are configured to connect a controller of a power supply, thus the ceramic heater 20*a* may form a 4PIN structure. Taking the material with positive temperature coefficient as an example, when the temperature of the heating element 203*a* and the ceramic body 201*a* raises too fast, the resistance of the thermistor layer 204*a* may increase significantly, and the current in the first temperature control-electrode 208 and the second temperature control-electrode 209 may also change, the controller of the power supply may reduce the output voltage or current, or adjust the output power for the heating element 203*a*, to control the heating element 203*a* to heat the liquid under a constant temperature range. Because the thermistor layer 204*a* is formed on the ceramic body 201*a* and is sintered integrally with the ceramic body 201*a*, the thermistor layer 204*a* could feed back the atomization temperature exactly, which could ensure the accuracy of temperature control.

The ceramic body 201*a* may include a wall and have a tube configuration, a plurality of through holes 2023 configured to release the aerosol to the air-flow passage 202*a* is defined in the wall, which is propitious to emit the aerosol smoothly, and could increase the atomization efficiency of the ceramic heater 20*a*. The heating element 203*a* is formed on the outer surface 2012*a*, so as to contact with the liquid directly, which is propitious to increase the atomization efficiency; while the thermistor layer 204*a* is formed on the inner surface 2011*a*, so as to feed back the real-time temperature directly, which could improve the accuracy of temperature controlling. It can be understood that the ceramic body 201*a* mentioned above may have a shape of square, polygonal, or other irregular shapes. The first electrode 206*a*, the second electrode 207*a*, the first temperature control-electrode 208 and the second temperature control-electrode 209 are located at the lower end of the ceramic body 201*a* and are uniformly distributed along a circumferential direction of the ceramic body 201*a* without any interference with each other, which may be conducive to connect with the conductive structure of atomizer.

In some embodiments, the heating element 203*a* and the thermistor layer 204*a* may be located on the same surface, such as the outer surface 2012*a* of the ceramic body 201*a*, and isolate to each other. A pattern of the heating element 203*a* may be different from that of the thermistor layer 204*a*. The patterns distribution of the heating element 203*a* and the thermistor layer 204*a* may be not interfere with each other, and isolated from each other. The thermistor layer 204*a* may be close to the heating element 203*a*, so as to reflect the real-time temperature of the heating element 203*a* accurately. Alternatively, the heating element 203*a* and the thermistor layer 204*a* may be stacked with each other, for example, the heating element 203*a* may be embedded in the surface of ceramic body 201*a*, while the thermistor layer 204*a* may be formed on the same surface and out of the heating element 203*a*. With this structure, the thermistor layer 204*a* may contact with the liquid, which may make thermistor layer 204*a* reflect the real-time atomization temperature directly.

In this embodiment, the heating element 203*a*, the thermistor layer 204*a* and the ceramic body 201*a* are sintered integrally. The specific moulding process may be: firstly, molding the ceramic body 201*a* with a plurality of through holes 2023 in the wall. Secondly, printing metal slurry on a piece of ceramic paper according with a predetermined pattern to form the heating element 203*a*, the ceramic paper may be pre-provided with holes with identical shapes as that of the through holes 2023, and printing material with positive temperature coefficient or negative temperature coefficient on the other piece of ceramic paper to form the thermistor layer 204*a* through the same method as that of forming the heating element 203*a*. Then, locating the ceramic paper with heating element 203*a* on the outer surface 2012*a*, locating the ceramic paper with thermistor layer 204*a* on the inner surface 2011*a*, and sintering integrally to cure the heating element 203*a* and the thermistor layer 204*a* on the ceramic body 201*a*. Finally, welding the electrodes and the temperature control-electrodes mentioned above on the ceramic body 201*a*, or sintering the electrodes and the temperature control-electrodes mentioned above with the ceramic body 201*a* integrally.

The ceramic heater 20*a* of this embodiment includes the heating element 203*a* formed on the ceramic body 201*a*, and the eating element 203*a* is sintered integrally with the ceramic body 201. The ceramic heater 20*a* further includes the thermistor layer 204*a* formed on the ceramic body 201*a*, and the thermistor layer 204*a* is sintered integrally with the ceramic body 201*a*, instead of a temperature sensor independently installed in the ceramic heater 20*a*. Thus, no assemblage is required, which may ensure the consistency of the product. Meanwhile, the thermistor layer 204*a* may reflect the atomization temperature accurately, which may make it realize that controlling temperature accurately, and the error could be reduced to +/−2° C. The first temperature control-electrode 208 and the second temperature control-electrode 209 on the thermistor layer 204*a* are connected to the a controller of the external power supply, With the heating element 203*a* and the ceramic body 201 heat persistently, the resistance of the thermistor layer 204*a* may vary. The temperature information may be fed back to the controller, and the controller may adjust the output power to ensure the temperature of the ceramic heater 10*a* to be constant, which may prevent the temperature from being too high.

An atomizer of electronic cigarette is provided in the present disclosure, the atomizer of electronic cigarette may include the ceramic heating atomizing core in any embodiments mentioned above.

Figure 6:
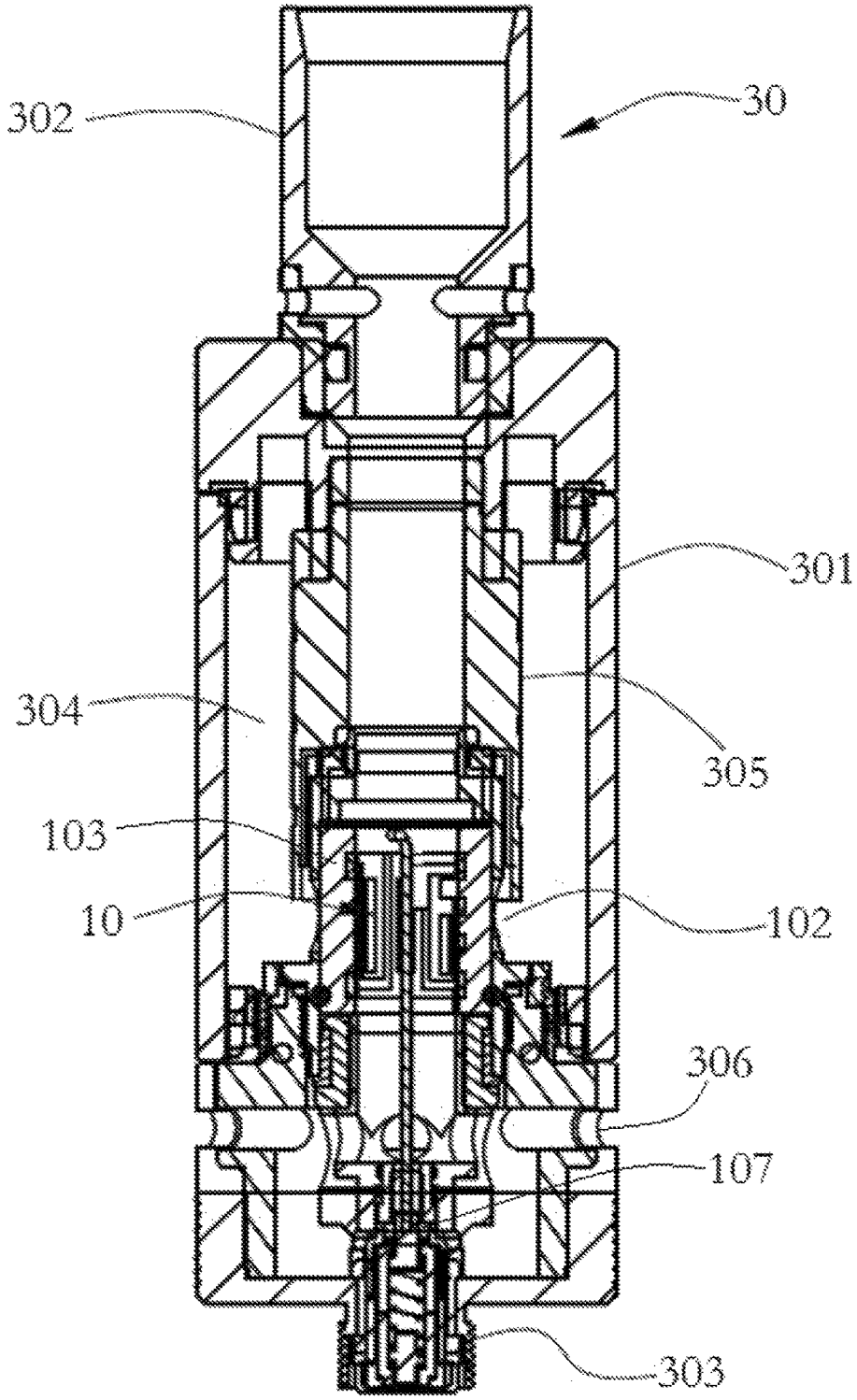
FIG. 6 is a cross-sectional view of the atomizer of electronic cigarette according to one embodiment of the disclosure.

Referring to FIG. 6, the atomizer 30 of electronic cigarette of this embodiment may include a main body 301 and a ceramic heating atomizing core 10 arranged inside the main body 301, the ceramic heating atomizing core 10 may include the ceramic heater 20 mentioned above.

One end of the main body 301 may be provided with a mouthpiece 302, while the other end of the main body 301 may be provided with an electrode assembly 303, the electrode assembly 303 is connected to the electric connection part 107, so as to connect the electrode assembly 303 with an external power supply and a controller of the power supply. An air tube 305 configured to communicate the mouthpiece 302 with the interior of the ceramic heating atomizing core 10 may be disposed inside of the main body 301. A liquid reservoir 304 configured to contain liquid is provided between the air tube 305 and the main body 301. The liquid guiding body 103 may be configured to absorb the liquid from the liquid reservoir 304, and the ceramic heater 20 may be configured to atomize liquid supplied by the liquid reservoir 304 to form aerosol for people to smoke. An air inlet 306 is disposed on the end of the main body 301 provided with the electrode assembly 303, the mouthpiece 302 is communicated with the air-flow passage 202, air absorbed from the air inlet 306 may take the aerosol in the air-flow passage 202 away, and be sucked out from the mouthpiece 302.

Figure 7:
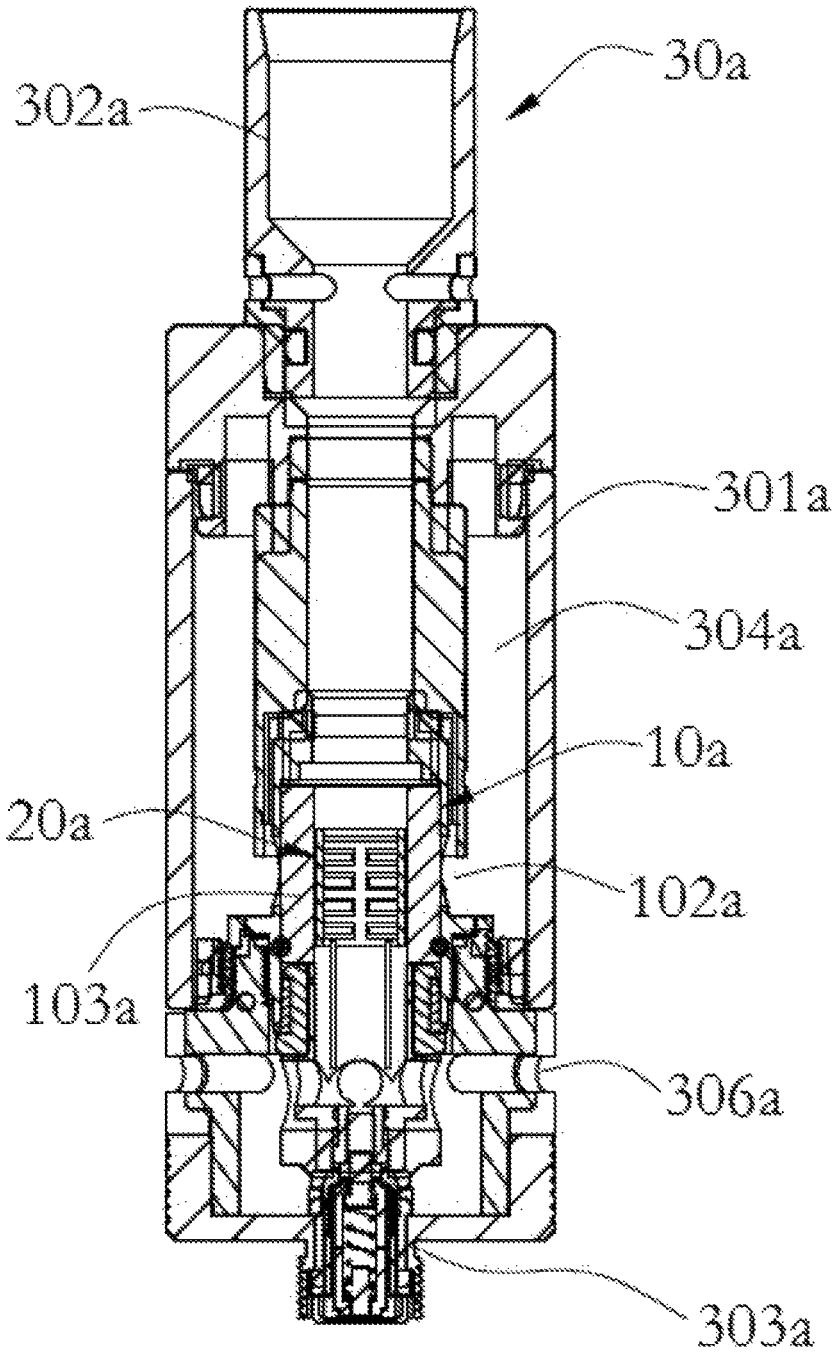
FIG. 7 is a cross-sectional view of the atomizer of electronic cigarette according to another embodiment of the disclosure.

Referring to FIG. 7, the atomizer 30*a* of electronic cigarette of this embodiment may include a main body 301*a* and a ceramic heating atomizing core 10*a* detachably arranged inside of the main body 301*a*, the ceramic heating atomizing core 10*a* may include the ceramic heater 20*a* mentioned above.

One end of the main body 301*a* may be provided with a mouthpiece 302*a*, while the other end of the main body 301*a* may be provided with an electrode assembly 303*a*. A liquid reservoir 304*a* configured to contain liquid may be defined inside of the main body 301*a*. The liquid guiding body 103*a* may be configured to absorb the liquid in the liquid reservoir 304*a*, and the ceramic heater 20*a* may be configured to atomize liquid in the liquid guiding body 103*a* to form aerosol for people to smoke. At least one air inlet 306*a* is defined in the lower end of the main body 301*a*, the mouthpiece 302*a* and the air-flow passage 202*a* inside the ceramic heater 20*a* are communicated with each other, the air absorbed from the air inlet 306*a* may take the aerosol in the air-flow passage 202*a* away, and be sucked out from the mouthpiece 302*a*.

In this embodiment, the first electrode 206*a*, the second electrode 207*a*, the first temperature control-electrode 208 and the second temperature control-electrode 209 are connected to relative conductive parts respectively.

The above description depicts merely some exemplary embodiments of the disclosure, but is meant to limit the scope of the disclosure. Any equivalent structure or flow transformations made to the disclosure, or any direct or indirect applications of the disclosure on other related fields, shall all be covered within the protection of the disclosure.

What is claimed is:

1. A ceramic heater, configured to atomize liquid to form aerosol, the ceramic heater comprising:

a ceramic body comprising a wall having an inner surface and an outer surface, the wall defining a plurality of through holes passing through the inner and outer surfaces to release the aerosol; and a heating element formed on one of the inner and outer surfaces of the ceramic body;

wherein the ceramic body has a tube configuration, and is integrally sintered with the heating element.

2. The ceramic heater of claim 1, wherein the plurality of through holes extends along an axial or circumferential direction of the ceramic body.

3. A ceramic heater, configured to atomize liquid to form aerosol, the ceramic heater comprising:

a ceramic body comprising a wall having an inner surface and an outer surface, the wall defining a plurality of through holes passing through the inner and outer surfaces to release the aerosol; and a heating element formed on one of the inner and outer surfaces of the ceramic body;

wherein the heating element is a metal heating layer printed on one of the inner and outer surfaces, the metal heating layer is connected to a first electrode and a second electrode which are used to connect a power supply.

4. The ceramic heater of claim 3, wherein a thermistor layer with positive temperature coefficient or negative temperature coefficient is printed on one of inner and outer surfaces, the thermistor layer and the metal heating layer are isolated from each other, and the thermistor layer is connected to at least one temperature control-electrode, which is used to feedback temperature information.

5. The ceramic heater of claim 4, wherein the thermistor layer is connected to one temperature control-electrode configured to connect a controller of the power supply, and the thermistor layer is also connected to one of the first electrode and the second electrode as a common electrode.

6. The ceramic heater of claim 4, wherein the thermistor layer is connected to a first temperature control-electrode and a second temperature control-electrode, which are configured to connect a controller of the power supply.

7. The ceramic heater of claim 6, wherein the ceramic body has a tube configuration, the first electrode, the second electrode, the first temperature control-electrode and the second temperature control-electrode are located at the lower end of the ceramic body and are uniformly distributed along a circumferential direction of the ceramic body.

8. The ceramic heater of claim 4, wherein the thermistor layer and the metal heating layer are arranged on the same surface.

9. The ceramic heater of claim 4, wherein the thermistor layer and the metal heating layer are arranged on different surfaces.

10. The ceramic heater of claim 4, wherein the thermistor layer and the ceramic body are integratedly sintered.

11. The ceramic heater of claim 3, wherein the metal heating layer is a metal variable resistance with positive temperature coefficient or negative temperature coefficient.

12. A ceramic heating atomizing core, comprising:

a ceramic heater comprising:

a ceramic base comprising a wall having an inner surface and an outer surface, the wall defining a plurality of through holes passing through the inner and outer surfaces to release an aerosol; and a heating element formed on one of the inner and outer surfaces of the ceramic base;

a liquid guiding body, configured to supply liquid for the ceramic heater to atomize to form the aerosol, wherein the liquid guiding body is in contact with one of the inner and outer surfaces;

wherein the ceramic heating atomizing core further comprises a shell which is used to carry the ceramic heater and the liquid guiding body, at least one liquid inlet is defined in the shell.

13. The ceramic heating atomizing core of claim 12, wherein the liquid guiding body is cotton cloth surrounding the ceramic heater, the cotton cloth is configured to absorb the liquid entered from the liquid inlet hole.

14. An atomizer of electronic cigarette, comprising:

a main body defining a liquid reservoir configured to contain liquid; and a ceramic heater arranged in the main body and configured to atomize liquid supplied by the liquid reservoir to form aerosol for people to smoke, the ceramic heater comprising:

a ceramic base comprising a wall having an inner surface and an outer surface, the wall defining a plurality of through holes passing through the inner and outer surfaces to release the aerosol; and a heating element formed on one of the inner and outer surfaces of the ceramic base;

wherein the ceramic heater is surrounded by an liquid guiding body, which is configured to absorb the liquid from the liquid reservoir and guide the liquid to the ceramic heater; and wherein the ceramic base has a tube configuration, and is integrally sintered with the heating element.

15. The atomizer of electronic cigarette of claim 14, wherein one end of the main body is provided with a mouthpiece, the other end of the main body is provided with an electrode assembly which is configured to connect to an external power supply;

the heating element is a metal heating layer printed on one of the inner and outer surfaces, the metal heating layer is connected to a first electrode and a second electrode;

the first electrode and the second electrode are connected to conductive part of the electrode assembly to connect the metal heating layer to the external power supply.

16. The atomizer of electronic cigarette of claim 15, wherein a thermistor layer with positive temperature coefficient or negative temperature coefficient is printed on one of the inner and outer surfaces, the thermistor layer and the metal heating layer are isolated from each other, and the thermistor layer is connected to at least one temperature control-electrode, which is used to feedback temperature information, and the at least one temperature control-electrode is connected to conductive part of the electrode assembly.

* * * * *